United States Patent [19]

Nezworski

[11] Patent Number: 4,832,064

[45] Date of Patent: May 23, 1989

[54] GLASS WASHER WITH ROTARY CARRIER

[75] Inventor: James E. Nezworski, Waukesha, Wis.

[73] Assignee: Perlick Corporation, Milwaukee, Wis.

[21] Appl. No.: 136,133

[22] Filed: Dec. 21, 1987

[51] Int. Cl.[4] ..... B08B 3/02

[52] U.S. Cl. ..... 134/44; 134/57 D; 134/81; 134/146

[58] Field of Search ..... 134/44, 49, 56 D, 57 D, 134/58 D, 80, 81, 96, 134, 140, 146

[56] References Cited

U.S. PATENT DOCUMENTS

| | | | |
|---|---|---|---|
| 1,520,110 | 12/1924 | Blakeslee | 134/80 |
| 2,643,659 | 6/1953 | Auten | 134/80 |
| 3,094,997 | 6/1963 | Nolte et al. | 134/81 X |
| 3,878,856 | 4/1975 | Hall | 134/80 X |
| 3,886,958 | 6/1975 | Diebel | 134/80 |
| 3,942,545 | 3/1976 | Flynn | 134/80 X |
| 4,191,592 | 3/1980 | Hansen et al. | 134/81 X |
| 4,420,003 | 12/1983 | Lee et al. | 134/80 |

*Primary Examiner*—Frankie L. Stinson

*Attorney, Agent, or Firm*—James E. Nilles; James R. Custin

[57] ABSTRACT

In a glass washing machine having a glass carrier rotatable on an upright axis, half of the carrier is always in an access zone where glasses can be loaded onto the carrier and removed from it, the other half in a cleansing zone where detergent solution is discharged from a first set of spray nozzles and germicidal rinsing solution is discharged from a second set of nozzles. Upon actuation of a pushbutton switch, the carrier rotates through 180°, always in the same direction, then stops until the switch is again actuatd. Liquids are discharged from all nozzles while the carrier rotates. Detergent solution is recirculated, but fresh detergent solution is introduced during a predetermined portion of each period of carrier rotation.

6 Claims, 8 Drawing Sheets

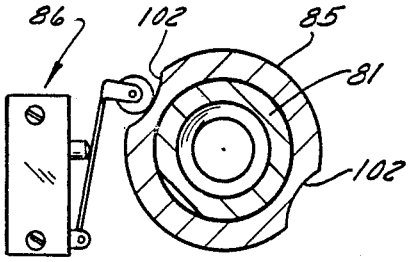
FIG. 14
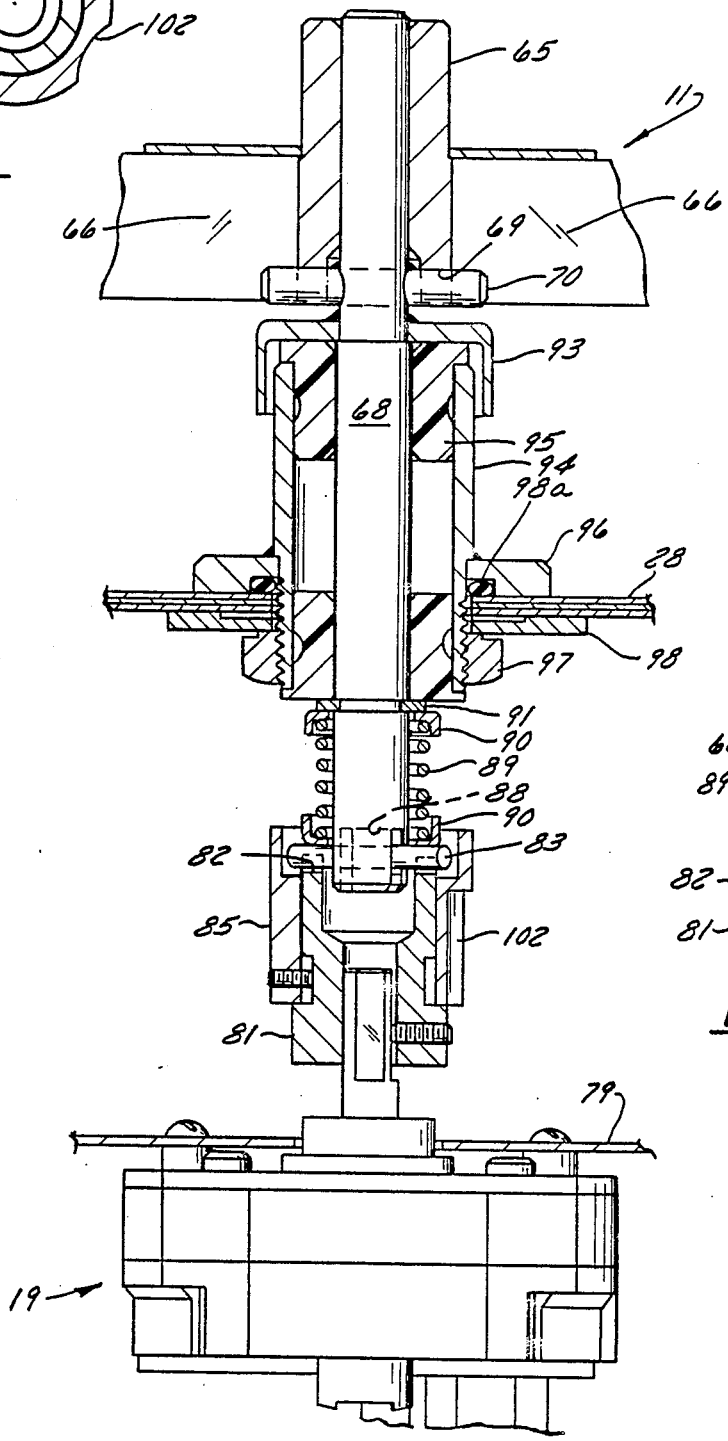
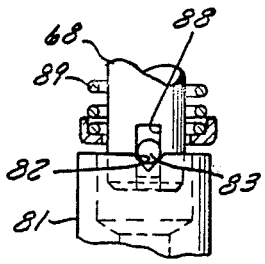
FIG. 13
FIG. 12

GLASS WASHER WITH ROTARY CARRIER

FIELD OF THE INVENTION

This invention relates to beverage glass washers for taverns and similar establishments and is more particularly concerned with a glass washing machine of the type having a rotary carrier on which glasses are carried orbitally from an access zone through a cleansing zone and back to the access zone, and having sets of nozzles in the cleansing zone from which cleansing liquids are discharged against the glasses.

RELATED APPLICATIONS

The applicant's co-pending application Ser. No. 117,155, filed Oct. 30, 1987 and still pending, discloses a linear-conveyor glass washing machine having certain features that are embodied in the machine of this application but are more fully described in that application. Certain other features of the herein-disclosed machine are more fully described in the applicant's copending application Ser. No. 158,665, filed Feb. 22, 1988 and still pending.

BACKGROUND OF THE INVENTION

In at least a substantial portion of the United States, machines for washing beverage glasses are required to meet standards set by the National Sanitation Foundation (NSF), according to which such a machine must subject glasses to a thorough soil-removing wash with a detergent solution that is at a temperature of at least 120° F., and then to a thorough rinse with a germicidal solution. Meeting these standards with an optimally efficient machine imposes significant costs for water, chemicals and electric current; but prior glass washing machines capable of meeting NSF standards, far from being efficient, have tended to operate in a very wasteful manner.

In a glass washing machine with a rotary carrier, glasses are carried around a circular path, one portion of which is in an access zone and the remainder of which is in a cleansing zone. Dirty glasses are loaded onto the portion of the carrier that is in the access zone. The rest of the carrier is meanwhile blocked by the spray nozzles and spray shields in the cleansing zone and is thus inaccessible for loading and unloading. When the machine is operating, liquid is normally discharged from all of the nozzles in the cleansing zone, and a certain amount of waste is involved in discharging such liquid against empty portions of the carrier.

An early rotary carrier machine intended specifically for washing glasses is disclosed in U.S. Pat. No. 2,360,156 to Ohme et al, issued in 1944. In that machine only hot water was discharged from the nozzles in the cleansing zone. On its way to the nozzles, the water passed through a water power motor by which the carrier was driven. Obviously, this machine was intended to operate continuously, rather than being manually turned on and turned off at intervals, and therefore it was likely to be left running with no glasses in it that needed cleaning, thus wasting water and the energy needed to heat it. The patent evidences a realization that letting the machine run unnecessarily was more convenient than operating it for economy, saying: "If desired, vessels may be allowed to repeatedly travel through the machine and subsequently removed when desired for use." This machine had n provision for the addition of detergent and germicide chemicals, so that it would not have complied with present NSF standards; but with such provisions its cost of operation would have been further increased by wastage of those chemicals.

A relatively recent machine specifically intended for washing glassware is disclosed in U.S. Pat. No. 3,878,856 to Hall, issued in 1975. It, too, had to be manually stopped as well as manually started, and therefore it could operate wastefully until someone remembered to shut it off and had the opportunity to do so. The likelihood of such manual shutoff has been measured by actual tests in a busy tavern-restaurant, using a metering device on a manually controllable glass washer. The tests showed that the machine was consistently allowed to run continuously for about eight hours at a time but was actually washing glasses during only about two hours of that period.

Other rotary carrier machines that operate continuously unless manually turned off are disclosed in U.S. Pat. Nos. 1,681,839 to Breton, 1,762,847 to Webb and 2,558,816 to Campbell. The last-mentioned patent discloses a milk can washer wherein the rotary carrier has a defined position for each can to be carried and has a lever at each position which is tripped by loading a milk can onto that position and which cooperates with valves that control flow of cleaning liquids to nozzles in respective sectors of the cleansing zone, so that no liquids are discharged against unoccupied portions of the carrier. This arrangement is obviously not suitable for a beverage glass washer that must accommodate glasses of widely varying shapes and sizes.

U.S. Pat. No. 3,731,696, to Hackney, discloses a rotary carrier glass washer having two auxiliary disc-like platforms that rotate in frictional engagement with the carrier, onto one of which dirty glasses are loaded and onto the other of which clean glasses are delivered by the carrier. In the specifically disclosed embodiment, the machine, once started, operates continuously, but the patent mentions that an automatic on-off switch may be so positioned relative to the unloading platform "that any object touching a contact lever of the switch will turn the apparatus off". This does not, in itself, solve the problem of wasteful operation because removal of all glasses from the unloading platform can leave the machine running with an empty carrier.

In machines disclosed in U.S. Pat. Nos. 2,703,580 to Cole, 3,094,997 to Nolte et al and 3,306,580 to Pahl et al, the rotary carrier moves intermittently to carry articles on it stepwise from an access zone, through each of a succession of cleansing zone sectors and back to the access zone, with a period of dwell for each sector of the cleansing zone. The machine of Pahl is used for cleaning insulators in an industrial process and is designed to be constantly attended by an operator who loads and unloads it. In the utensil washing machine of Nolte et al the carrier is rotated manually, requiring substantially constant presence of an attendant during its operation and thus exchanging the possible cost of wasted water, chemicals and current for probably higher labor costs. In the glassware washing machine of Cole the rotary carrier is likewise rotated manually for each advance, but a timer mechanism stops discharge of cleansing liquids after the carrier has remained in any one of its positions of rotation for a predetermined time interval so that "the operator is free to leave the machine when desired".

A very important disadvantage of moving the rotary carrier intermittently and stepwise is that glasses are stationary relative to the spray nozzles all during their period of dwell in each sector of the cleansing zone. Because tavern beverage glasses are usually of different shapes and sizes, they necessarily have a random arrangement on the carrier so that some of them can partly shield others from direct impingement by sprayed liquid. Such shielding can occur only transiently when the glasses move at a steady rate through the cleansing zone, since every glass is then presented in a variety of orientations to the spray from each nozzle in every sector of that zone. To avoid this shielding problem; the above mentioned Nolte et al patent teaches that the nozzles should be mounted on rotating arms, but this solution tends to impose limits upon the area that can be covered by spray from the orbitally moving nozzles, as well as being obviously expensive and potentially troublesome.

In addition to providing for total sanitation of glasses with optimum cost effectiveness and maximum convenience for the personnel who work with it, a completely satisfactory glass washing machine must have a high rate of throughput combined with utmost compactness. A busy tavern cannot have enough glasses on hand to operate through a full business day without washing a substantial number of them, and when clean glasses are needed they should be available without undue delay for a slow washing cycle. On the other hand a tavern glass washer is ordinarily located behind the bar, where space is limited, and therefore high capacity cannot be gained at the expense of utmost compactness. Another consideration in this respect is that the machine must be capable of being so positioned in relation to a bar that a bartender can load it and unload it without turning away from customers at the other side of the bar, and must be so arranged that no part of it interferes with the bartender's full view of customers or with access to all parts of the bar top.

Although some prior glass washing machines have been capable of achieving totally sanitized glasses at a reasonable rate of throughput, and have been reasonably compact, none has met the additional important requirements for operation with minimal waste of water, chemicals and electric current and for requiring minimum attention from bar and table service personnel for the attainment of such economy. Evidently the simultaneous satisfaction of all of these essential requirements has heretofore been well beyond the reach of mere skill in the art.

SUMMARY OF THE INVENTION

The general object of this invention is to provide a glass washing machine which is particularly well suited for installation behind a tavern bar and which has a high rate of throughput, fully complies with National Sanitation Foundation standards to assure clean and germ-free glasses, and operates with minimum consumption of water, chemicals and electric current while demanding minimal attention from personnel concerned with its operation.

Another object of this invention is to provide a highly efficient automatic glass washer of the type that has a rotary carrier whereon glasses to be washed are carrie orbitally from an access zone where glasses are loaded onto the carrier and unloaded from it, through a cleansing zone, and back to the access zone, said glass washer being so arranged that it normally operates with its carrier completely loaded with glasses notwithstanding that the substantial portion of the carrier that is in the cleansing zone is inaccessible, thus ensuring optimally efficient utilization of water, chemicals and electric current.

A further and more specific object of the invention is to provide an automatic rotary carrier glass washing machine which is very compact in relation to its capacity and which is well suited for installation behind a bar, where it can be loaded and unloaded by a bartender who faces customers while performing those operations and where it does not interfere with access to any portion of the bar top.

It is also a specific object of this invention to provide an automatic glass washing machine that operates efficiently while demanding a minimum of attention, requiring only that dirty glasses be placed on its carrier, cleaned glasses be removed from it at convenient times, and that a start button be pushed when it is loaded.

Another specific object of the invention is to provide a rotary carrier glass washing machine which is so arranged that one half of its carrier is always in an access zone where dirty glasses can be loaded onto it and clean glasses can be removed from it while the other half of the carrier is always in a cleansing zone wherein sprays of cleansing liquids are discharged towards the carrier when the machine is in operation, said machine being further so arranged that it can be started in operation by momentary actuation of a pushbutton switch and, after such switch actuation, continues to operate while the carrier rotates through 180°, whereupon it automatically stops and remains out of operation until restarted by actuation of the switch.

In connection with this last stated object, it is also a specific but important object of the invention to provide simple, reliable and inexpensive control means for stopping the carrier each time it has been rotated through exactly 180° and for accurately programming consumption of water and cleansing chemicals to ensure optimum economy of operation while achieving total cleanliness and sterilization of glasses washed by the machine.

Other specific objects include provisions for fast and easy routine daily maintenance and for ensuring that the machine will consistently operate with cleansing liquids that have the temperatures and chemical concentrations specified in National Sanitation Foundation standards, discharged at the rates and for the times required to meet those standards.

BRIEF DESCRIPTION OF DRAWINGS

In the accompanying drawings, which illustrate what is now regarded as a preferred embodiment of the invention:

FIG. 12 is a detail view of the carrier drive mechanism in vertical section;

FIG. 13 is a detail view of the clutch portion of the carrier drive mechanism, shown in elevation at right angles to the plane of FIG. 12;

FIG. 14 is a detail plan view of the cam and the switch that cooperates with it to control the 180° rotations of the carrier.

DETAILED DESCRIPTION OF PREFERRED EMBODIMENT OF THE INVENTION

General Arrangement and Manner of Operation

Figure 1:
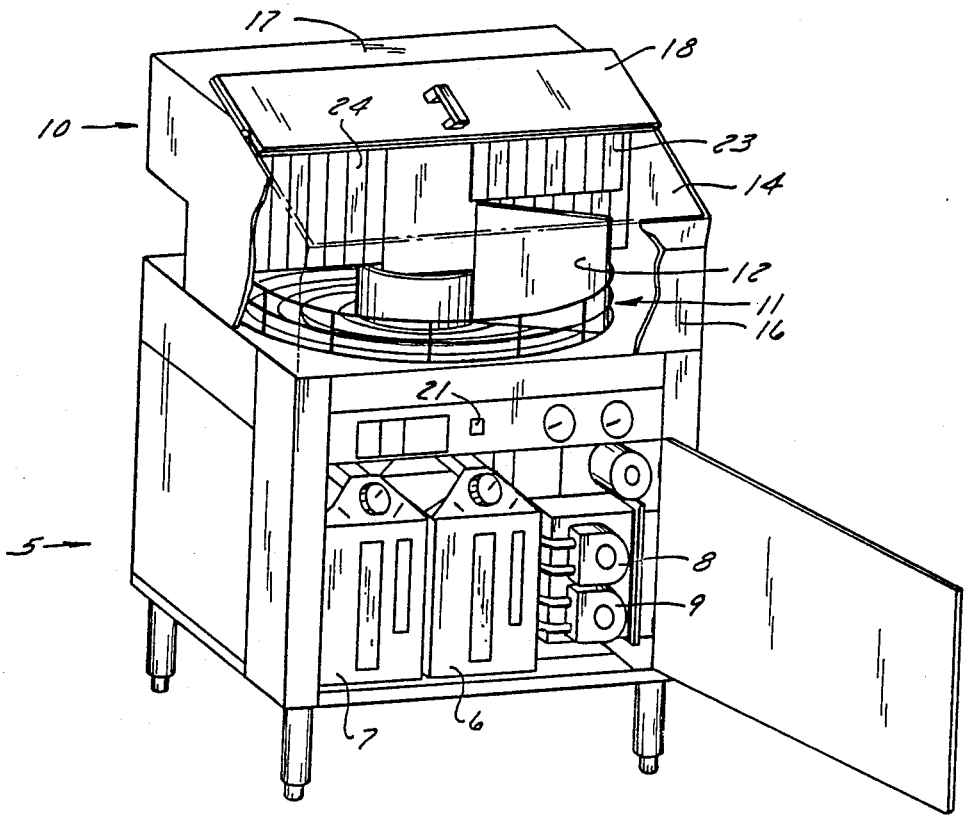
FIG. 1 is a front perspective view of a glass washing machine of this invention, with a portion of the front wall of its housing shown broken away.
Figure 2:
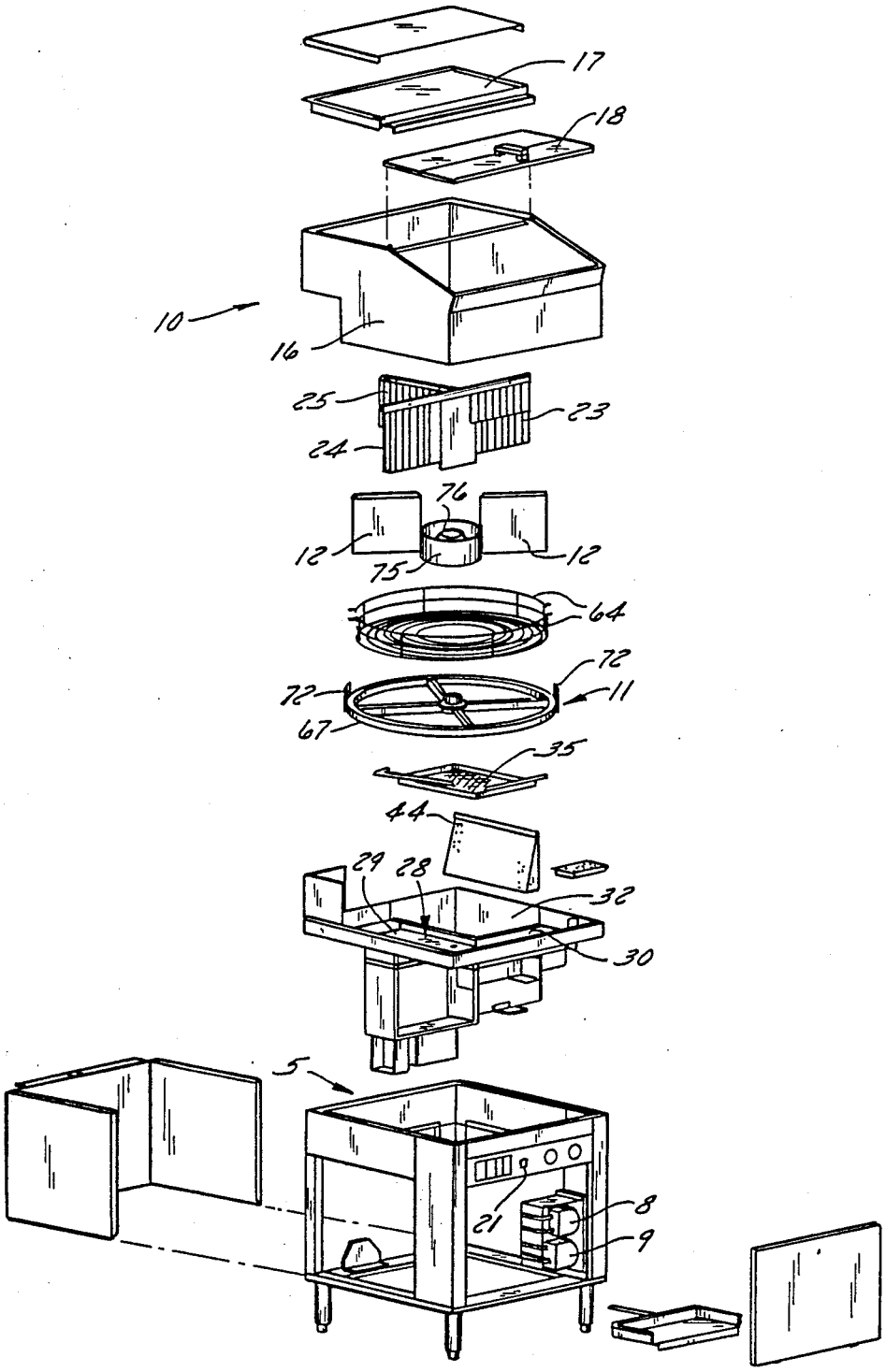
FIG. 2 is an exploded perspective view of principal components of the machine.
Figure 3:
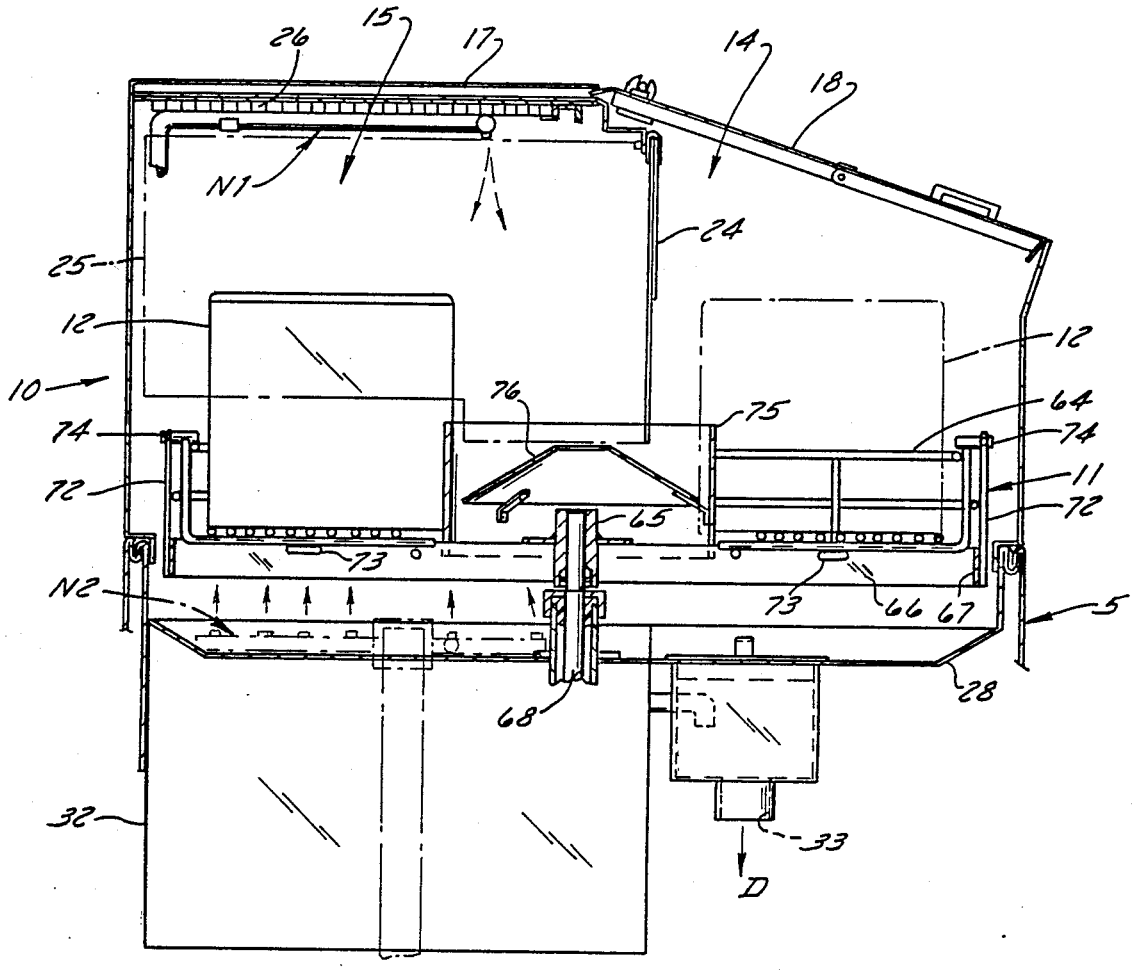
FIG. 3 is a view of the machine in vertical section, taken substantially on a fore-and-aft extending plane containing the rotary carrier axis and with the lower cabinet omitted.
Figure 4:
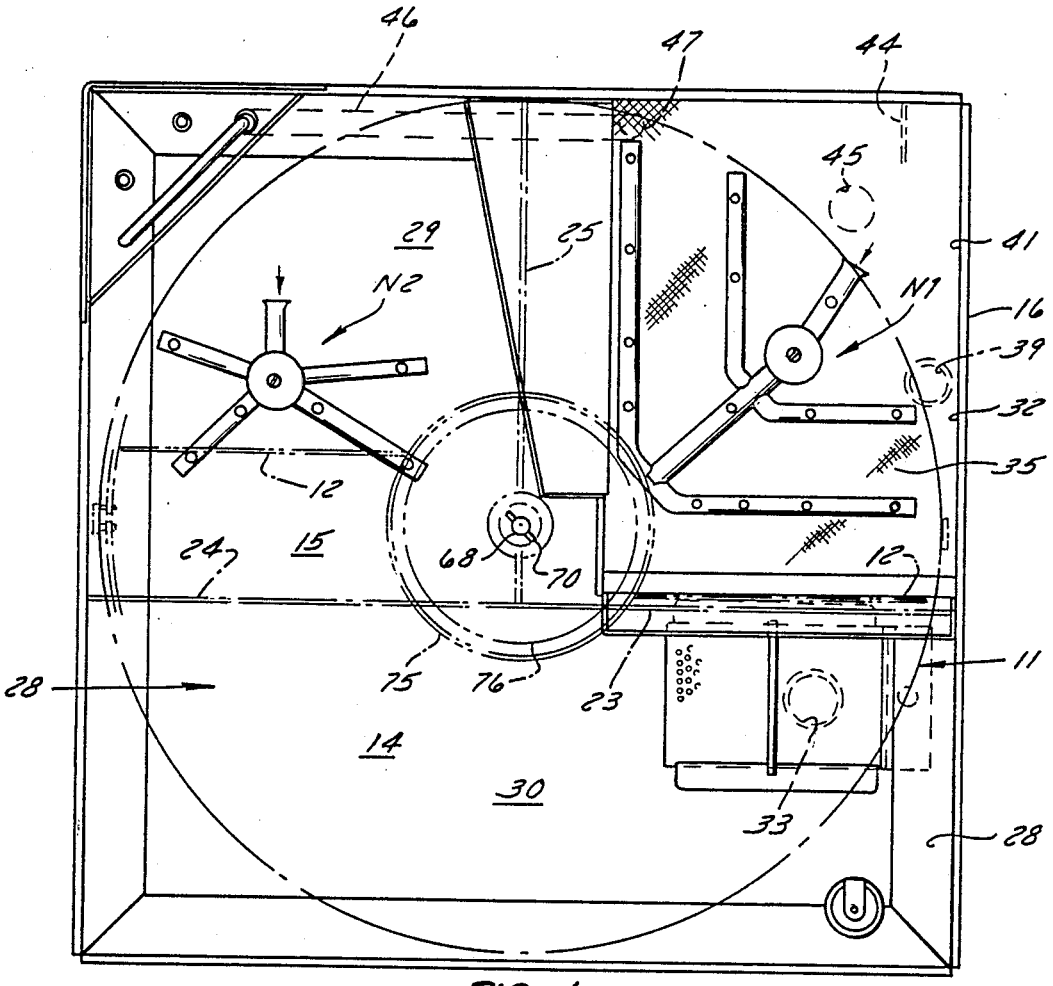
FIG. 4 is a view of the machine in horizontal section, taken on a plane between the carrier and the top wall of the housing.
Figure 5:
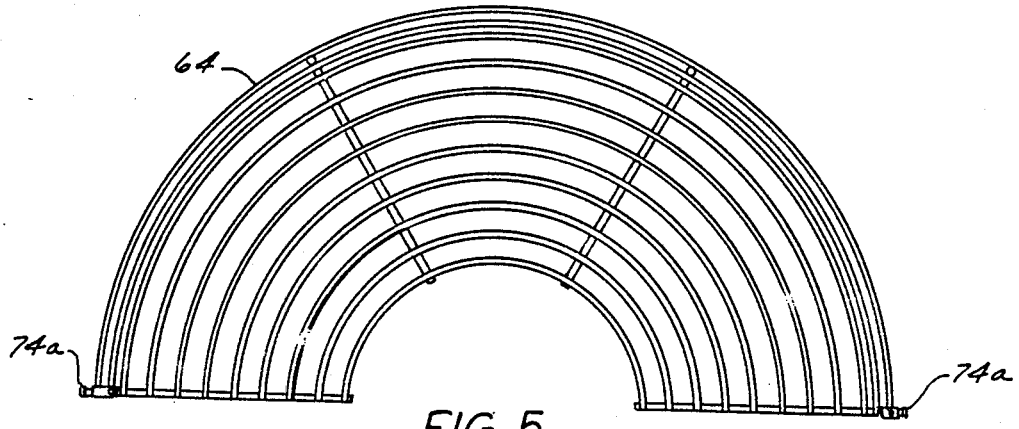
FIG. 5 is a plan view of one of the two identical racks of the carrier.
Figure 6:
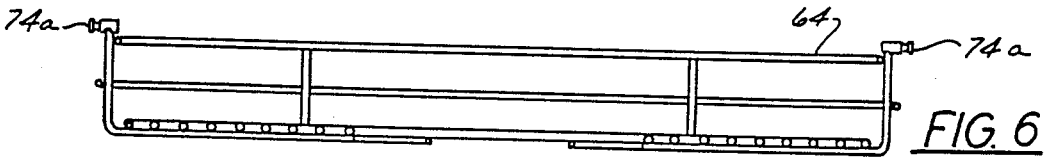
FIG. 6 is a view in elevation of the rack shown in FIG. 5.
Figure 7:
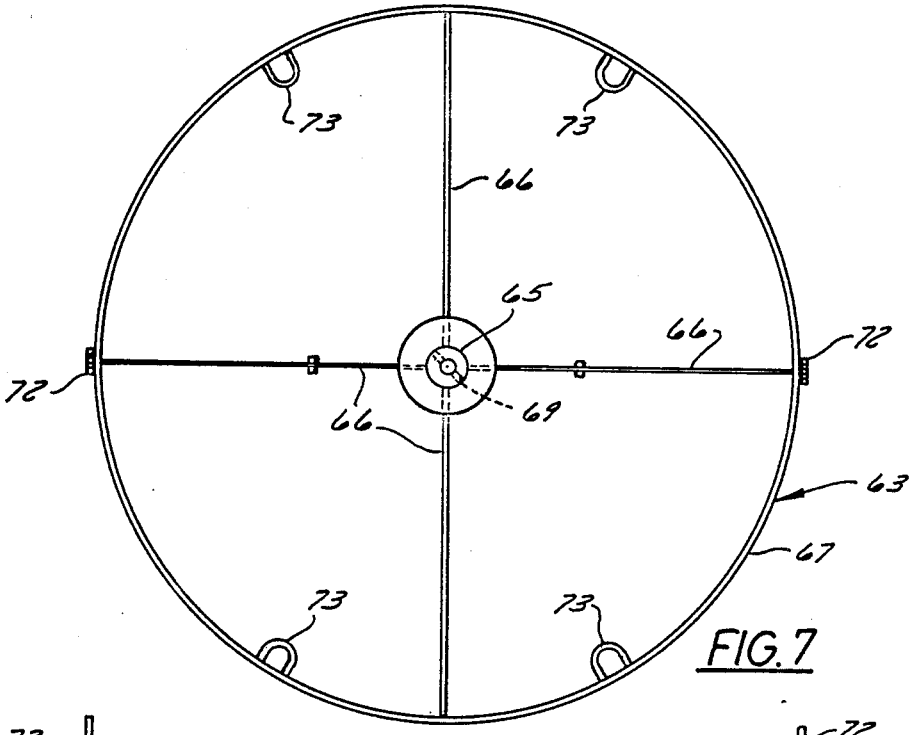
FIG. 7 is a plan view of the carrier frame.
Figure 8:
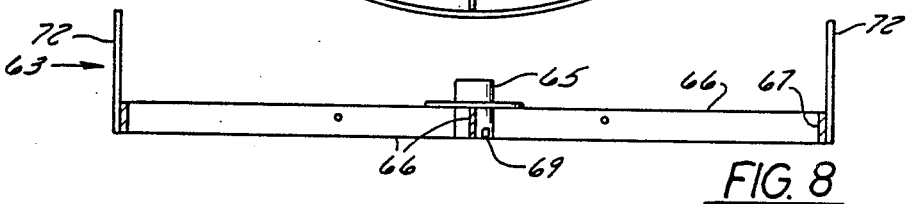
FIG. 8 is a view of the carrier frame in vertical section.
Figure 9:
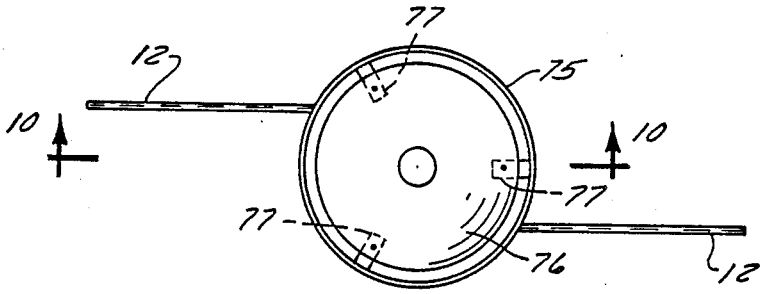
FIG. 9 is a plan view of the central deflector assembly of the carrier.
Figure 10:
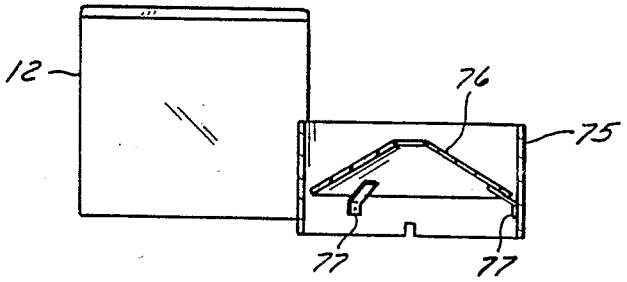
FIG. 10 is a view in section taken on the plane of the line 10—10 in FIG. 9.
Figure 11:
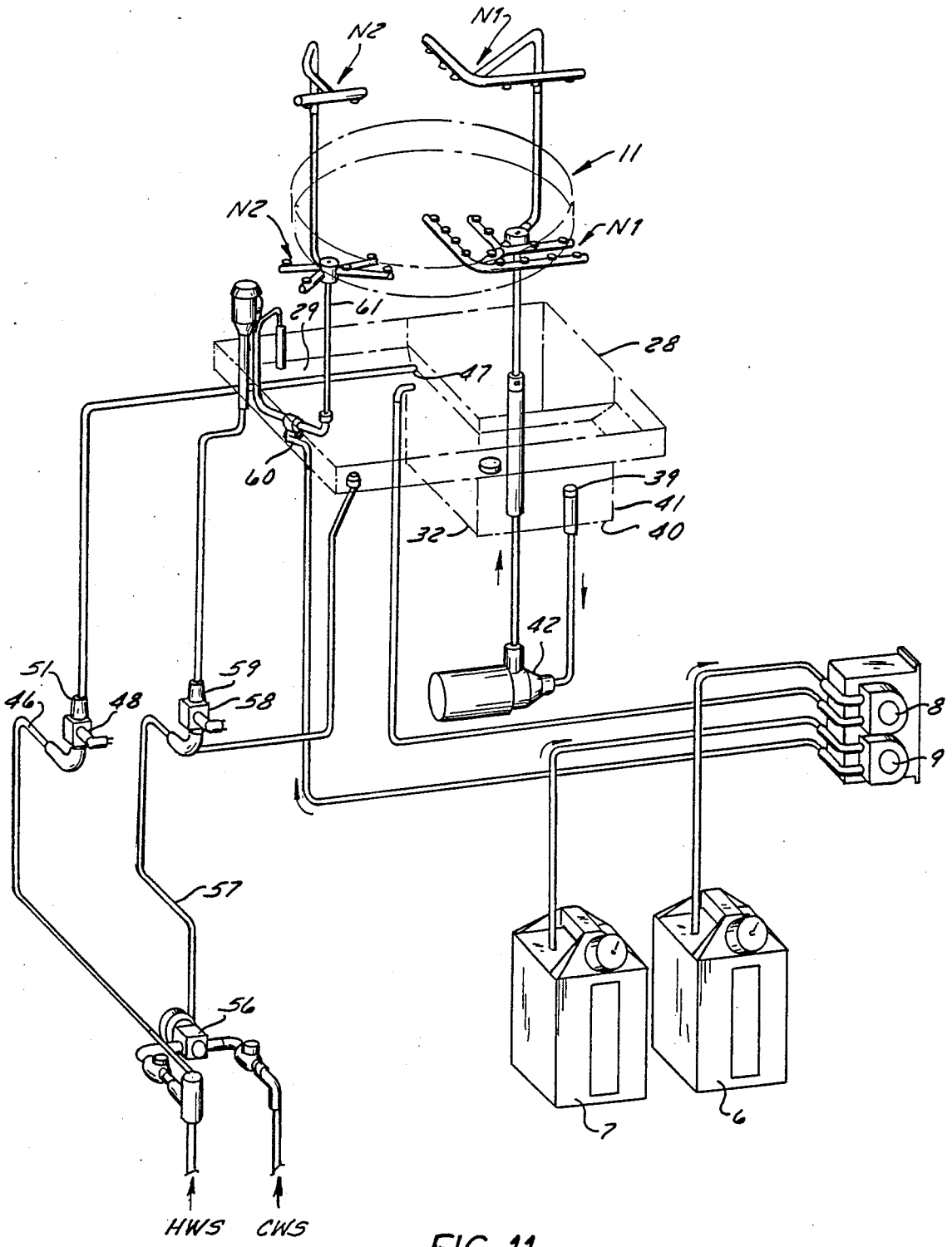
FIG. 11 is a diagrammatic perspective view of the liquids circulation systems.
Figure 15:
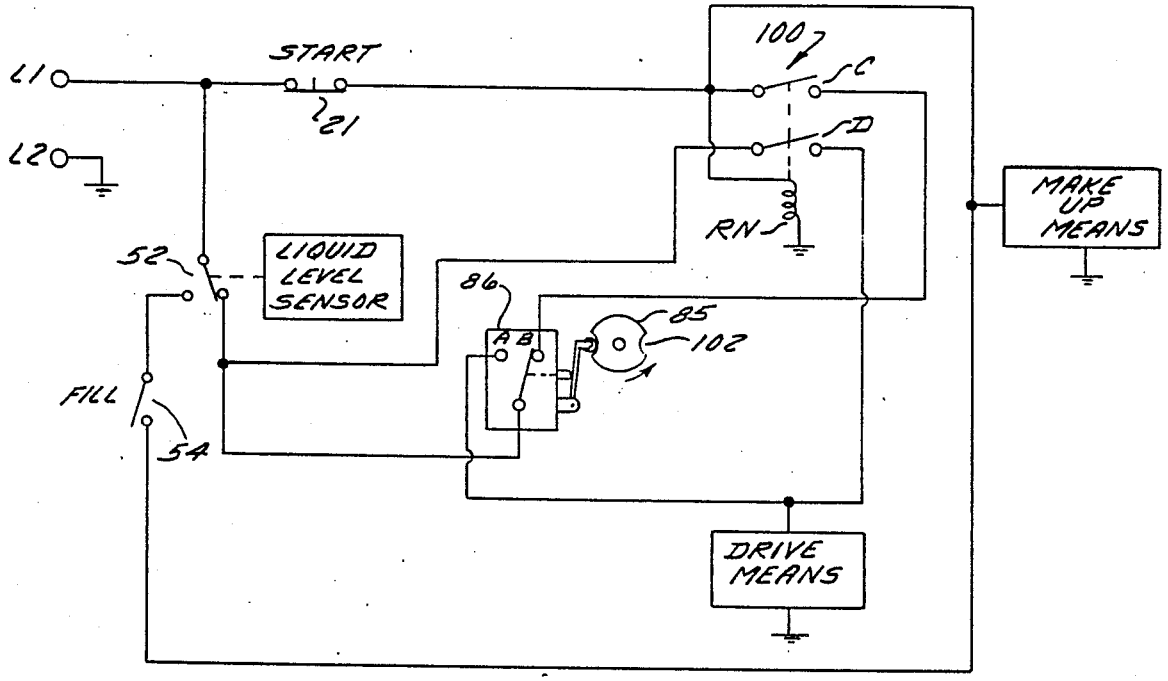
FIG. 15 is a simplified diagram of the electrical circuitry of the machine.

A glass washing machine of this invention has fixed structure that defines a lower cabinet 5 on which is supported a housing 10. The cabinet 5 accommodates chemical reservoirs 6 and 7, chemical pumps 8 and 9, and certain other equipment described hereinafter. In the upper housing 10, wherein a glass carrier 11 is rotatable about a relatively stationary upright axis, there are two zones that are on opposite sides of a plane containing that axis, namely, an access zone 14 in which glasses can be placed on the carrier and removed from it, and a cleansing zone 15 in which glasses on the carrier are subjected to sprays of cleansing liquids issuing from stationary nozzles N1, N2. Since the plane between these zones contains the carrier axis, one half of the carrier 11 is always in the cleansing zone 15 and the other half is in the access zone 14.

The upper housing 10 comprises upright walls 16 which project substantially above the carrier 11 and are arranged in a square around it, and a top wall 17 that overlies the half of the carrier that is in the cleansing zone, cooperating with the upright walls 16 to define an enclosure for the cleansing zone that is open to the access zone. Within this enclosure are two sets of stationary nozzles N1, N2, each set consisting of a group of upper nozzles, mounted just beneath the top wall 17 and arranged to discharge obliquely downwardly, and a group of lower nozzles that are mounted beneath the carrier and discharge obliquely upwardly through it. A folding cover 18 can be closed to overlie the portion of the carrier that is in the access zone. This cover is normally kept closed when the machine is in operation, although it can be left open without danger that spray will escape from the machine.

The top of the housing 10 is at a level well below that of a conventional bar top so that the machine can be placed partway under a bar, at the rear or bartender's side thereof, with its cleansing zone portion beneath the bar top and its access zone portion projecting behind the bar. With the half of the carrier 11 that is in the access zone thus accessible from above, glasses to be cleaned can be loaded downwardly onto the carrier and their distribution on it can be readily seen for positioning them in a compactly efficient arrangement.

An electric motor 19 that is mounted in the cabinet 5 drives the carrier 11 through reduction gearing incorporated in the motor structure. As the carrier rotates, glasses on it are carried through a washing sector of the cleansing zone wherein sprays of a detergent washing liquid are discharged against them from the set of nozzles N1 and then through a rinsing sector of that zone wherein sprays of germicidal rinsing liquid are discharged against them from the nozzles N2.

Dirty glasses will usually be loaded onto the carrier 11 while the machine is not in operation. When the half of the carrier that is in the access zone 14 is filled to capacity, the machine can be started by momentary actuation of a pushbutton start switch 21 that is accessibly mounted on the exterior of the housing. Whenever the machine is operating, the carrier rotates at a steady rate, always in the same direction, and cleansing liquids are caused to issue from all of the nozzles N1, N2 as explained hereinafter. After an actuation of the start switch 21, the carrier rotates through 180°, whereupon the machine stops and carrier rotation and liquid discharges terminate. For the first operation of the day, all glasses that are on the carrier when it stops are in the cleansing zone 15, and the portion of the carrier that is in the access zone 14 is empty. Normally this empty portion of the carrier will be loaded with dirty glasses as they accumulate, and the start switch 21 will again be actuated when the access zone is filled. When the operation again stops after 180° of carrier rotation, there will be a load of clean glasses in the access zone to be unloaded and replaced with dirty glasses.

With this manner of operation the portion of the carrier that is in the cleansing zone is always (after the first operation of the day) fully loaded for optimum utilization of water and chemicals, and a complete load of clean glasses is always available after a delay period no longer than is needed for 180° of carrier rotation, or a time interval on the order of 90 seconds. Since the carrier rotates rather slowly and can be loaded and unloaded while the machine is in operation, some clean glasses can be available within a few seconds after actuation of the start switch 21, assuming that the half of the carrier then in the cleansing zone had been fully loaded.

It will be observed that when the carrier stops after each 180° of rotation, certain of the glasses on it (those that are about to enter the access zone) will have received substantially the whole cleansing treatment, while others, which have just entered the cleansing zone, will have received only a few seconds of detergent liquid spray. However, in the course of two 180° carrier rotations every glass of one load will have passed completely through the cleansing zone to receive the full treatment of detergent and rinsing sprays, and, in addition, will have remained more or less completely wetted by one or the other of the cleansing liquids during the interval between those two half-revolutions.

Mounted on the carrier 11 are two upright partition plates 12, one at each side of the carrier axis and each extending edgewise substantially radially in relation to that axis. These partition plates 12 are so located on the carrier that when the carrier is stopped between its 180° rotations they lie substantially in the plane that defines the access zone 14 from the cleansing zone 15, and they thus define two identified halves of the carrier. Hence, no sanitation problem is presented by loading or unloading the carrier while the machine is in operation because clean glasses are physically separated from dirty ones by the partition plate 12 that is then in the access zone.

Glasses on the carrier 11, in passing from the access zone into the cleansing zone, are carried through a vertical curtain 23 of supple plastic material that has numerous vertical slits extending from near its top all the way to its bottom edge; and they pass through another such curtain 24 as they are carried from the cleansing zone back into the access zone. Each of these curtains 23, 24 is substantially in the above mentioned plane between the access zone and the cleansing zone, and the curtains are, of course, at opposite sides of the carrier axis. The curtains prevent the escape of spray from the cleansing zone into the access zone.

A third and generally similar curtain 25 is located in the cleansing zone and divides that zone into the washing sector in which the detergent liquid nozzles N1 are located and the rinsing sector in which the rinsing liquid nozzles N2 are located. As explained hereinafter, the hot detergent solution discharged from the nozzles N1 is collected and reused, whereas the rinsing liquid is discarded to drain after one use. The curtain 25 prevents the collected detergent solution from being diluted and cooled with rinsing liquid and prevents detergent spray from entering the rinsing sector.

Apparatus in Cleansing Zone

In underlying engagement with the top wall 17 of the housing in each sector of the cleansing zone is a grid 26, resembling an egg-crate grid, that provides numerous vertical surfaces and causes liquid sprayed up against the top wall from the lower nozzles to run down in streams that are distributed more or less uniformly across the sector, to increase cleansing efficiency. The nature and purpose of these grids is more fully explained in the applicant's co-pending application, Ser. No. 158,665, which also discloses the assemblies that comprise the nozzles N1, N2 and the manner in which they are mounted to be readily removable for cleaning or replacement.

At a level beneath the lower groups of nozzles is an L-shaped drain pan 28, one portion 29 of which extends all across the rinsing sector to catch all liquid discharged from the rinsing nozzles N2 and the remainder 30 of which underlies the carrier in the access zone to catch all liquid that drips off of cleaned glasses in that zone. All liquid that falls into the drain pan 28 runs down along it to an outlet 33 in it that discharges into the waste drain D. The outlet 33 is in the access zone, to facilitate cleaning.

Underlying the washing sector of the cleansing zone, beneath the carrier and the lower group of washing nozzles N1, is an open-top screening vessel 35 which catches substantially all liquid discharged from the washing nozzles and which overlies an open-top tank 32. At least the lower portion of the screening vessel 35 is made of fine mesh screening, preferably stainless steel sheet having numerous apertures of not larger than 0.02 inch diameter, so that all of the detergent solution entering the screening vessel normally falls through it into the tank 32, from which such liquid is recirculated back to the washing nozzles. Glasses to be washed often contain material such as berry seeds or bits of fruit pulp or paper napkin that is washed off of them by the detergent solution and could clog the washing nozzles if fed to them with the recirculated liquid. The screening vessel 35 catches at least the major portion of such material, and the apertures in its screening portion are smaller than the apertures in the washing nozzles. If the apertures in the screening vessel 35 become blocked to a substantial extent, liquid overflows from the screening vessel to the drain pan 28, which conducts the overflowing liquid to the waste drain D. The screening vessel 35 is readily removably supported in the stationary structure comprising the drain pan 28 and the tank 32, to facilitate cleaning it.

Because makeup liquid is from time to time charged into the tank 32 as explained hereinafter, that tank overflows from time to time. Such overflow takes place through an overflow outlet 37 in the tank, at a substantial distance above its bottom, communicated with the waste drain D. Excessive soiling of the detergent solution is prevented by this infeed of fresh liquid and discard of used solution.

Apparatus for Mixing and Delivering Solutions

For recirculation of detergent solution, the tank 32 has a recirculation outlet 39 near the junction of its bottom wall 40 with one of its upright side walls 41. A centrifugal-type wash pump 42, mounted beneath the tank, withdraws detergent solution from the tank through the recirculation outlet 39 and delivers it under pressure to the washing nozzles N1 for discharge from them. Inside the tank 32, extending across the recirculation outlet 39, there is a flat, rectangular fine-mesh screen 44 that is inclined to the vertical and has each of its edges engaged along its length with one of the walls of the tank, so that all liquid leaving the tank must pass through this inclined screen on its way to the recirculation outlet. The inclined screen 44 thus catches any foreign matter that may not have been caught by the screening vessel 35 and thereby provides insurance against blockage of the washing nozzles that would interfere with total sanitization of glasses. For the most part, the inclined screen 44 is self-cleaning, as explained in the applicant's copending application, Ser. No. 117,155, and for the rest it can be readily cleaned by rinsing it off with a hose or the like. At the opposite side of the inclined screen 44 from the recirculation outlet 39, the tank bottom wall 40 has a drain outlet 45 that is normally closed when the machine is in operation and is opened for cleaning of the tank and its screen.

For makeup, a water duct 46 connected with a water utility source HWS, preferably a source of hot water, has an outlet 47 near the top of the tank 32. A normally closed solenoid valve 48 in the hot water duct 46 is opened for filling the tank before the start of a day's operations and is thereafter opened only during a predetermined interval (typically 10 seconds) at the beginning of each 180° rotation of the carrier. Since hot makeup liquid is thus introduced only intermittently, and there is a substantial cooling of the washing liquid as it is discharged against glasses being cleaned, there is an electric heating element in the tank 32, near the bottom thereof, which is energized as necessary to maintain the detergent solution at the prescribed minimum temperature. The heating element and the thermostatic switch that controls it are not shown, since these elements, as well as the inclined screen 44, are fully disclosed in the above mentioned Ser. No. 117,155.

For maintaining a constant, predetermined concentration of detergent chemical in the detergent solution, water and detergent solution are always delivered to the tank simultaneously, each at a constant flow rate. To this end the rate of inflow of hot water is controlled by a flow control valve 51 (such as a sphincter valve) in the hot water infeed duct 46, which compensates for variations in water source pressure; and detergent chemical from a reservoir 6 in the lower cabinet 5 is delivered into the tank 32 by means of a constant volume pump 8 (such as a peristaltic pump) that is always energized simultaneously with energization of the solenoid of the hot water valve 48. Water and detergent chemical are discharged obliquely downwardly into the tank 32 and such discharge, together with the recirculation process, affords sufficient agitation of the tank contents to assure thorough mixing.

Because of the programmed infeed of makeup liquid as described hereinafter, and because overflow from the screening vessel 35 is discarded to drain, a substantial blockage of the screen portion of the screening vessel can cause the level of detergent solution in the tank 32 to drop so low that insufficient washing liquid is delivered to the washing nozzles N1. If the machine were permitted to operate after this occurred, glasses would not be properly cleaned. To prevent that result and compel cleaning of the screening vessel, a double-throw switch 52 that is responsive to the level of liquid in the tank is connected in the electrical circuitry of the machine. A float actuated switch could be used, but it is preferred to use a pressure responsive snap switch that is communicated with the interior of the tank, near the bottom thereof, through an air trap tube (not shown) that prevents the liquid level responsive switch 52 from being contacted by detergent solution. When the liquid level in the tank 32 is satisfactorily high, the switch 52 maintains an operating condition in which it permits energization of the circuits that provide for normal operation of the machine. When detergent solution in the tank 32 falls to a critically low level, the switch 52 snaps to an opposite fill condition in which the drive mechanism is disconnected from the current source but in which the makeup means comprising the hot water solenoid valve 48 and the detergent chemical pump 8 can be energized through it and a manually actuatable fill switch 54. When liquid in the tank 32 rises to a satisfactorily high level, somewhat below the level at which overflow takes place through its drain outlet, the liquid level switch 52 snaps back to its operating condition in which the fill switch 54 is out of the energizing circuits for the makeup means and in which the machine can operate in its normal manner.

Water for rinsing solution is obtained from an automatic thermostatic blending valve 56 which has inlets connected with the hot water utility source HWS and with a cold water utility source CWS and which so mixes the water from these sources that the water at its outlet has the 75° F. temperature prescribed for germicidal rinsing liquid. The outlet of the blending valve 56 is communicated with one inlet of a mixer 60 through an infeed duct 57 in which there is a cool water solenoid valve 58 and a flow control valve 59 that compensates for any variations in source pressure. To the other inlet of the mixer 60 germicidal chemical is delivered by means of a constant volume pump 9, such as a peristaltic pump, that has its inlet communicated with a germicide reservoir 77 in the cabinet 5. Whenever the carrier 11 is driven in rotation, the germicide pump 9 and the cool water solenoid valve 58 are both energized. The outlet of the mixer 60 is connected with the rinsing nozzles N2 by means of a rinsing liquid duct 61, so that germicidal solution is delivered to those nozzles by water utility pressure whenever the cool water solenoid valve 58 is open. It will be apparent that the flow control valve 59 and the constant volume germicide pump 9 cooperate to maintain a predetermined level of concentration of the germicidal rinsing solution. As pointed out above, rinsing solution is drained away after discharge from the rinsing nozzles and is not recycled.

If desired, a sensor can be arranged in each of the chemical ducts, just downstream from the constant volume pump 8 or 9 which delivers into that duct. Such sensors are not shown in the accompanying drawings, inasmuch as they are optional and are fully described and explained in the applicant's copending application, Ser. No. 117,155. Briefly, each such sensor maintains one condition in the presence of chemical in its duct and assumes an opposite condition in the absence of that chemical. If said opposite condition persist for a predetermined time interval, as measured by a time delay device (not shown) that is connected with the sensor, the machine is caused to shut down. The sensors thus ensure that the machine will not operate with one of its chemical reservoirs 6 or 7 empty.

Glass Carrier and Its Drive

The rotary carrier 11 comprises a frame 63 and a pair of racks 64 that are hinged to the frame and are readily removable from it. The frame 63 comprises a central hub 65, four struts 66 that are secured to the hub and extend radially from it at right angles to one another, and a circular rim 67 concentric to the hub that is secured to the outer ends of the struts. An upright shaft 68, extending through the drain pan 28 and confined to rotation relative to the fixed structure as described hereinafter, has its upper end portion closely but slidably received in a concentric bore in the hub 65. At its bottom, the hub 65 has a pair of downwardly opening radial slots 69 that receive an upper cross-pin 70 which is fixed in the shaft 68 and which constrains the carrier frame 63 to rotate with the shaft 68 but allows the carrier to be removed by simply lifting it off of the shaft.

The two racks 64 are identical, each in the shape of half an annulus and made of heavy plastic-coated wire. When the carrier is stopped in either of its 180° positions of rotation, one of these racks 64 is completely in the access zone and the other is completely in the cleansing zone. Each of the racks is hinged to a pair of upright mounting brackets 72 that are fixed on the carrier frame 63, so that the rack in the access zone can be swung upward about its diametral edge to a vertical position in which it permits ready access to the portion of the drain pan 28 that is in the access zone. In its normal horizontal position, each rack is supported by its mounting brackets 72 in cooperation with radially inwardly projecting U-shaped abutments 73 that are fixed on the rim portion 67 of the carrier frame. At their tops the mounting brackets 72 have upwardly opening grooves in which hinge pins 74 on the racks are received, so that in addition to being upwardly swingable out of the way, each rack 64 can be completely removed from the carrier frame 63 by simply lifting it straight up.

Concentrically seated on the carrier frame 63 is a central deflector assembly which comprises a cylindrical sheet metal wall 75, an inner cone 76 and the upright partition plates 12. The cylindrical wall 75 has a diameter somewhat smaller than the inside diameter of the annulus defined by the two racks 64, and its height is such that liquids discharged from the spray nozzles ten to strike its outer surface and run down along it into the screening vessel and the wash tank. Such sprayed liquids as pass over the top of the cylindrical wall strike the conical deflector 76, which tapers upwardly and is concentrically supported within the cylindrical wall 75 by means of a few circumferentially spaced connecting tabs 77. Since the cone 76 has a maximum diameter somewhat smaller than the inside diameter of the cylindrical wall, there is a radially narrow annular space between the cylindrical wall and the lower edge of the cone through which liquids that run down along the cone can fall into the screening vessel and the drain pan.

The upright partition plates 12 are secured to the cylindrical wall 75 a diametrically opposite sides of it. Although projecting more or less radially outwardly from that wall, these plates are offset to opposite sides of a diametral line and extend parallel thereto, so that when the carrier is in each of its 180° stopped positions, one plate 12 is in the access zone, flatwise adjacent to the slitted curtain 23 that glasses pass in moving into the cleansing zone, and the other plate is in the cleansing zone, similarly adjacent to the other slitted curtain 24. Thus, as the carrier rotates through the last few degrees before it is stopped, the partition plates 12 cooperate with the respective curtains 23, 24 in excluding spray from the access zone, and they do not displace those curtains until the carrier begins a new 180° rotation.

The assembly comprising the partition plates rests on the carrier frame and can be removed by simply lifting it up off of that frame. Notches in the bottom edge of the cylindrical wall receive the struts 66 of the carrier frame to confine the assembly in concentric relation to the carrier axis and with the partition plates 12 properly oriented.

The gear motor 19 that drives the carrier is mounted on a bracket 79 beneath drain pan 28. Secured to the upwardly projecting output shaft of the gear motor is a coupling body 81 that has a diametral upwardly opening V-groove 82 in its top to provide for a detenting clutch connection between the gear motor 19 and the shaft 68 that is connected with the carrier frame hub 65. Concentrically surrounding the upper portion of the coupling body 81 and secured to it as by means of a set screw is an axially elongated cam body 85, the cam portion of which cooperates with a lever actuated snap switch 86 that is mounted on a bracket adjacent to the cam body. The cam body 85 and the switch 86 cooperate to control the 180° rotations of the carrier as explained hereinafter.

Normally seated in the V-groove 82 in the top of the coupling body 81 is a lower cross-pin 83 that is freely slidably received in a cross-slot 88 in the lower portion of the shaft 68. The lower cross pin 83 is substantially confined against motion parallel to its own length by the upper portion of the cam body 85, which projects above the coupling body 81 and which has an upwardly opening concentric counterbore with a diameter slightly greater than the length of the cross-pin 83. The cross-slot 88 in the shaft 68 is vertically elongated to leave the cross-pin 83 free for limited up and down motion relative to that shaft. The cross-pin is biased towards the lower end of the slot 88 and into normally seated engagement in the V-groove 82 by means of a coiled expansion spring 89, surrounding the shaft 68 and bearing downwardly against the end portions of the cross-pin. The spring 89 reacts upwardly against an annular spring seat cup 90 that surrounds the shaft 68 and is confined against upward displacement by an overlying E-clip ring 91 engaged in a circumferential groove in the shaft that is spaced a substantial distance above the top of the cross-slot 88. When rotation of the carrier is resisted, as for example if an excessively tall pitcher on the carrier engages the housing, rotation of the coupling body 81 cams the lower cross-pin 83 out of the V-groove 82 in the coupling body 81, permitting the latter to be rotated by the gear motor without applying excessive force to the carrier through the shaft 68; and in a similar manner the clutch connection afforded by the cross-pin 83 and the V-groove 82 allows the carrier to be manually rotated relative to the coupling body 81 and the gear motor 19 connected therewith. It will be observed that when this clutch connection is engaged, the carrier is always in one of a pair of predetermined orientations relative to the coupling body 81 and the cam body 85 that is secured to it, which orientations are 180° apart.

Concentrically fixed to the shaft 68 at a small distance below the upper cross-pin 70 is an annular bearing cup 93, the rim of which projects downwardly. Projecting upwardly into this bearing cup 93 is a bearing sleeve 94 which is removably secured to the bottom wall of the drain pan 28 and in the upper end portion of which there is seated a plug-like annular bearing 95 of nylon or the like through which the shaft 68 extends with a close rotating fit. The underside of the end wall of the bearing cup 93 rests on the flat top surface of the bearing 95 to provide axial support for th shaft 68. Fixed to the bearing sleeve 94 intermediate its ends, and in downwardly spaced relation to the side wall of the bearing cup 93, is a downwardly dished flange 96 that supportedly overlies the upper surface of the drain pan 28 around a hole therein through which the bearing sleeve extends. The lower portion of the bearing sleeve 94 is threaded to receive clamping nut 97 whereby a gasket washer 98 around the bearing sleeve is confined against the underside of the drain pan. The clamping nut 97 cooperates with the flange 96 to maintain the gasket washer 98 in clamped sealing engagement with the drain pan 28, all around the bearing sleeve hole therein, and also to maintain an O-ring **98*a* in compressively clamped sealing engagement between the flange 96 and the upper surface of the drain pan 28**.

Electrical Control System

When washing liquid in the tank 32 is at an adequately high level, the machine can be started by momentary depression of the pushbutton start switch 21. The carrier 11 then rotates through 180°, preferably at about 2° per second, while the drive means comprising the carrier drive motor 19, the wash pump 42, the cool water solenoid valve 58 and the germicide pump 9 are constantly energized. However, the makeup means comprising the hot water solenoid valve 48 and the detergent chemical pump 8 are energized during only about the first 20° of this 180° carrier rotation, to provide a programmed delivery of fresh makeup liquid to the tank during about the first 10 seconds of each operating interval.

The mechanism that controls the 180° rotations of the carrier and the infeed of makeup liquid during the initial portion of each carrier rotation comprises the cam 85 that is constrained to rotate with the coupling body 81 on the output shaft of the carrier drive motor 19, the double-throw snap switch 86 that is mounted adjacent to the cam and is arranged for actuation by it, and a double-pole relay 100. The cam actuated snap switch 86 has two contacts A and B with which its contactor is alternatively engageable, depending upon the rotational position of the cam 85. The contactor of the snap switch is connected with one terminal $L_1$ of the current supply for the machine and is biased towards engagement with the contact B.

The cam 85 is so configured that during a major part of each carrier rotation a constant-radius portion of the cam holds the roller lever actuator of the snap switch 86 in a position wherein the snap switch contactor is maintained in engagement with the contact A, which is connected for energizing the drive means whereby the carrier is rotated and liquids are delivered to the nozzles N1, N2 in the cleansing zone. During this major part of each 180° carrier rotation, there is no energization of the makeup means that provides for delivery of hot water and detergent chemical to the tank 32.

At the end of 180° of carrier rotation a bay or recess 102 in the cam 85 comes into alignment with the roller on the lever actuator for the cam actuated switch 86, permitting the contactor of that switch to snap under its bias into engagement with the B contact. In this condition of the snap switch 86, neither the drive means nor the makeup means is energized and the machine is shut down. The cam 85 has two bays or recesses 102 that are 180° apart, so that it arrives at a shut-down position after each 180° of carrier rotation.

With the cam 85 in a shut-down position of its rotation, actuation of the pushbutton start switch 21, which is connected between the current source terminal $L_1$, and the winding RW of the double-pole relay 100, momentarily energizes that winding, thus closing the relay contacts C and D. The contact C of the relay is connected in a self-energizing circuit, in series with the relay winding RW and, through snap switch terminal B, with the current source terminal $L_1$. While the relay contacts remain closed, the makeup means is energized, being connected with the current source though the relay contact C as here shown. The other contact D of the relay, when closed, connects the drive means with the current source terminal $L_1$. Thus, after momentary actuation of the start switch 21, and so long as the cam actuated snap switch 86 remains in its B condition, the carrier is driven in rotation, liquids are delivered to the nozzles N1, N2, and makeup liquids are delivered to the tank 32.

Each of the bay 102 in the cam 85 provides a gradual rise that swings the actuator lever of the snap switch 86 against its bias and snaps the switch to its A condition after the cam has been rotated through a predetermined angle (typically 20°) following actuation of the start switch 21. With the snap switch contactor thus disengaged from its B contact, the relay winding RW is no longer energized through the self-energizing circuit which includes that contact, and the relay opens, shutting off the hot water solenoid valve 48 and the detergent chemical pump 8 to terminate delivery of makeup liquid to the tank 32. However, the drive means continues in operation, now energized through the A contact of the snap switch, until the carrier completes 180° of rotation, bringing the cam back to its shut-down position at which the snap switch is flipped over to its B condition.

It will be observed that the cam is symmetrical to a diametral line. While its shut-down positions could be defined by lobes instead of bays (with a reversal of the A and B contact connections to the snap switch), bays are preferred because they provide for abrupt drop-offs whereby the lever actuator of the snap switch 86 is flipped instantaneously for a change of snap switch condition at exactly the 180° positions of cam rotation. Because of the 180° symmetry of the cam, the single snap switch 86 with which it cooperates can be readily adjusted for stopping the carrier in exactly the desired positions of its rotation. The bays 102 of the cam are configured to define the interval during which makeup detergent solution is delivered at the beginning of each 180° rotation and can be readily designed for such accurate timing of the delivery of makeup liquid that consumption of water and chemicals are reliably programmed and predictable.

From the foregoing description taken with the accompanying drawings it will be apparent that this invention provides a beverage glass washer for taverns and similar establishments that has a high rate of throughput, operates with minimum consumption of water, chemicals and current, requires very little attention from the personnel who work with it, and nevertheless achieves complete cleanliness and germ-free sterilization of the glasses that it washes.

What is claimed is:

1. A machine for washing articles such as beverage glasses, comprising stationary structure that defines an access zone where articles can be loaded into and unloaded from the machine and a cleansing zone wherein there are a plurality of nozzles from which cleansing liquids are discharged against articles to be washed, a carrier rotatable about a fixed upright axis and whereon articles to be washed can be carried at locations all around said axis for orbital transport from said access zone through said cleansing zone and back to the access zone, electrically energizable drive means on said fixed structure for rotating said carrier in one direction and for causing cleansing liquids to be discharged from said nozzles, a tank wherein liquid discharged from certain of said nozzles is collected and from which that liquid is withdrawn and fed back to said certain nozzles for redischarge from them, and electrically energizable makeup means for delivering fresh liquid into said tank, said machine being characterized by:

A. said zones being on opposite sides of a plane that contains said axis so that substantially one half of the carrier is in each of said zones;

B. circuit closing means comprising a manually actuatable switch, said circuit closing means being connectable with an electric current source and connected with said drive means for initiating and maintaining energization of said drive means upon actuation of said manually actuatable switch;

C. circuit opening means connected with said circuit closing means and with said drive means and responsive to the position of rotation of the carrier to terminate energization of said drive means each time the carrier has rotated through 180° following actuation of said manually actuatable switch, said circuit opening means comprising (1) a cam constrained to rotation in unison with rotation of the carrier and (2) cam actuated switch means having two alternative conditions and cooperating with said cam to be converted thereby from one to the other of said conditions each time the carrier completes 180° of its rotation following actuation of said manually actuatable switch;

D. said cam being arranged to maintain said cam actuated switch means in said other of its conditions while the carrier rotates through a predetermined angle, substantially less than 180°, following each actuation of said manually actuatable switch; and E. said cam actuated switch means having connections with said manually actuatable switch and with said makeup means that provide for energization of said makeup means in consequence of the manually actuatable switch being actuated and while said cam actuated switch means is thereafter in said other of its conditions.

2. The machine of claim 1 wherein said manually actuatable switch is a normally open momentary contact switch and wherein said cam actuated switch means provides in its said one condition for connection of said drive means with said current source, further characterized in that said circuit closing means further comprises:

a relay (1) having a winding connected with said manually actuatable switch to be energized by closure thereof and (2) having at least one set of normally open contacts (a) which are closed in consequence of energization of said winding and (b) which are connected with said winding and with said cam actuated switch in a self-energizing circuit whereby energization of the winding is continued so long as the cam actuated switch is in said other of its conditions but is terminated upon conversion of the cam actuated switch to its said one condition.

3. The machine of claim 2, further characterized by: said relay having normally open contacts which are connected with said makeup means to energize the same while the winding of the relay remains energized in consequence of the cam actuated switch means being in its said other condition.

4. The machine of claim 1, further characterized by: baffle means on said carrier having a pair of upright plate-like partitioning portions each of which extends edgewise substantially radially across the carrier and which cooperate to define two halves of the carrier, said baffle means being so oriented in relation to said cam that at the conclusion of each 180° rotation of the carrier each of its said halves is substantially entirely in one of said zones.

5. A machine for washing articles such as beverage glasses, comprising stationary structure that defines an access zone where articles can be loaded into and unloaded from the machine and a cleansing zone wherein there are a plurality of nozzles from which cleansing liquids are discharged against articles to be washed, said stationary structure comprising a tank in which liquid discharged from certain of said nozzles is collected and from which such liquid is fed back to said certain nozzles for redischarge from them, a carrier rotatable about a fixed upright axis and whereon articles to be washed can be carried at locations all around said axis for orbital transport by the carrier from said access zone through said cleansing zone and back to the access zone, electrically energizable drive means on said fixed structure for rotating the carrier in one direction and for causing cleansing liquids to be discharged from said nozzles, and electrically energizable makeup means for delivering fresh liquid into said tank, said machine being characterized by:

A. said zones being on opposite sides of a plane that contains said axis;

B. circuit closing means connectable with an electric current source and connected with said drive means, said circuit closing means comprising (1) a manually actuatable switch for initiating energization of said drive means and (2) means for continuing energization of said drive means following actuation of said manually actuatable switch;

C. circuit opening means connected with said circuit closing means and with said drive means and arranged to terminate energization of the drive means whenever rotation of the carrier has brought it to either of a pair of predetermined positions of its rotation that are 180° apart; and D. said makeup means having connections with said circuit closing means and said circuit opening means whereby the makeup means is energized during a predetermined portion of each period of energization of said drive means that is initiated by an actuation of said manually actuatable switch and terminates when the carrier arrives at one of said positions of its rotation.

6. A machine for washing articles such as beverage glasses, comprising stationary structure that defines an access zone where articles can be loaded into and unloaded from the machine and a cleansing zone wherein there are a plurality of nozzles from which cleansing liquids are discharged against articles to be washed, a carrier rotatable about a fixed upright axis and whereon articles to be washed can be carried at locations all around said axis for orbital transport from the access zone through the cleansing zone and back to the access zone, electrically energizable drive means on said fixed structure for rotating said carrier in one direction and for causing cleansing liquids to be discharged from said nozzles, a tank wherein liquid discharged from certain of said nozzles is collected and from which that liquid is withdrawn and fed back to said certain nozzles for redischarge from them, and electrically energizable makeup means for delivering fresh liquid into said tank, said machine being characterized by:

A. said zones being on opposite sides of a plane that contains said axis, so that substantially one half of the carrier is in each of said zones;

B. means for terminating energization of said drive means when the carrier arrives at each of a pair of predetermined positions of its rotation that are 180° apart;

C. means comprising a manually actuatable switch connectable with an electric current source and connected with said drive means for manually initiating energization of the drive means when the carrier is in each of its said positions of rotation and for maintaining such energization until the carrier arrives at the other of its said positions of rotation, so that the half of the carrier that is in the access zone when said switch is actuated will be in the cleansing zone when the carrier next stops; and D. means for energizing said makeup means during a fractional part of each period of energization of said drive means that begins with actuation of said manually actuatable switch and ends when the carrier next thereafter arrives at one of its said positions of rotation.

* * * * *